US008776747B2

(12) United States Patent
Schafer et al.

(10) Patent No.: US 8,776,747 B2
(45) Date of Patent: Jul. 15, 2014

(54) NON-RETURN VALVE OF A CAMSHAFT ADJUSTER

(71) Applicant: Schaeffler Technologies AG & Co. KG, Herzogenaurach (DE)

(72) Inventors: Jens Schafer, Herzogenaurach (DE); Martin Steigerwald, Herzogenaurach (DE); Michael Busse, Herzogenaurach (DE); Jurgen Plate, Gerhardshofen (DE); Andreas Wedel, Emskirchen (DE); Olaf Boese, Nuremberg (DE); Steffen Racklebe, Obermichelbach (DE)

(73) Assignee: Scheaffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/751,243

(22) Filed: Jan. 28, 2013

(65) Prior Publication Data

US 2013/0199476 A1 Aug. 8, 2013

(30) Foreign Application Priority Data

Feb. 2, 2012 (DE) ..... 10 2012 201 570

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01)
USPC ..... 123/90.17; 123/90.15

(58) Field of Classification Search
CPC ..... F01L 1/3442; F01L 1/344; F01L 2001/34433; F01L 2001/34479; F01L 2001/34446
USPC ..... 123/90.15, 90.17, 90.31
See application file for complete search history.

(56) References Cited

U.S. PATENT DOCUMENTS

2012/0111295 A1 5/2012 Plate et al.

FOREIGN PATENT DOCUMENTS

WO 2011032805 3/2011

*Primary Examiner* — Zelalem Eshete
(74) *Attorney, Agent, or Firm* — Volpe and Koenig, P.C.

(57) ABSTRACT

A stator (20) for a camshaft adjuster (4). The stator (20) has a ring-shaped outer part (50) for the concentric holding of a rotor (22) with vanes (34) that project in the axial direction and are arranged on the periphery around the rotor (22) and a segment (52) that projects inward in the radial direction from the ring-shaped outer part (50) for engaging between two vanes (34) of the rotor (22), in order to form, together with the two vanes (22), pressure chambers (44) of the camshaft adjuster (4). Here, the segment (52) has a cavity (70) for holding a hydraulic fluid from the pressure chambers (44).

10 Claims, 4 Drawing Sheets

NON-RETURN VALVE OF A CAMSHAFT ADJUSTER

INCORPORATION BY REFERENCE

The following documents are incorporated herein by reference as if fully set forth: German Patent Application No.: DE 102012201570.1, filed Feb. 2, 2012.

FIELD OF THE INVENTION

The invention relates to a stator for a camshaft adjuster, the camshaft adjuster, and an internal combustion engine with the camshaft adjuster.

BACKGROUND

Camshaft adjusters are technical assemblies for adjusting the phase positions between a crankshaft and a camshaft in an internal combustion engine.

From WO 2011 032 805 A1, it is known to arrange a volume accumulator in a camshaft adjuster, wherein hydraulic fluid can be drawn from this volume accumulator by the pressure chambers in the case of an under-pressure.

SUMMARY

The invention is directed to improving the known camshaft adjuster.

The invention discloses a stator for a camshaft adjuster that comprises a ring-shaped outer part for the concentric holding of a rotor with vanes that project in the axial direction and are arranged on the periphery around the rotor, a segment that projects inward in the radial direction from the ring-shaped outer part for engaging between two vanes of the rotor, in order to form, together with the two vanes, pressure chambers of the camshaft adjuster, and a cavity that is opened toward a pressure chamber via a non-return valve.

In one refinement of the invention, the cavity is formed in the segment and is opened outward in and/or against the peripheral direction of the ring-shaped outer part by the non-return valve. The construction of the cavity in the segment is especially favorable, because the segment is already otherwise present as installation space and thus can be used beneficially in the stator.

In one special refinement, the non-return valve is arranged, seen from the cavity, on an outer side of the segment, so that the non-return valve is integrated directly on the faces adjacent to the pressure chamber space. The non-return valve thus has an access to the pressurized chamber area by which the adjustment function is generated.

In another refinement of the invention, the stator comprises a cover that is placed in the axial direction on the ring-shaped outer part and in which the cavity is formed. The cavity in the cover can form the volume accumulator together with or as an alternative to the cavity in the segment. Both cavities can be connected to each other internally or else each could also be opened for itself to the pressure chamber. Alternatively, it is also possible to form the cavity in the segment and to open it toward the pressure space by the cover or, in the reverse arrangement, to form the cavity in the cover and to open it toward the pressure space by the segment.

The invention also discloses a camshaft adjuster for adjusting a phase position of a camshaft relative to a crankshaft in an internal combustion engine. The disclosed camshaft adjuster comprises a paired number of volume-changing advanced and retarded pressure chambers for adjusting the phase position by a rotor mounted in a stator so that it can move, and a volume accumulator with an accumulator connection for storing a hydraulic fluid from the pressure chambers and with a tank connection for discharging the hydraulic fluid to a tank. Here, a number of pressure chambers are each connected by an additional channel enclosing a non-return valve oriented toward the respective pressure chamber, wherein the number is less than the total number of all pressure chambers. The disclosed camshaft adjuster starts from the idea that the volume accumulator has the task of equalizing under-pressures mainly in periodic phases in that the pressure chamber draws hydraulic fluid from the volume accumulator. In this way, a movement of the rotor caused by the under-pressure in the direction opposite the actually planned adjustment is prevented. The disclosed camshaft adjuster is based on the idea, however, that not all pressure chambers must contribute to the prevention of this reversal of movement, in that they draw hydraulic fluid from the volume accumulator. It is sufficient when this is realized by only a few pressure chambers, because the under-pressure can be easily compensated by these few pressure chambers. If fewer pressure chambers draw hydraulic fluid from the volume accumulator in the case of an under-pressure, these also do not consequently need to be equipped with a correspondingly large storage capacity, wherein not only installation space, but also weight can be saved during operation.

In an especially preferred way, the stator of the disclosed camshaft adjuster can be a stator disclosed in the introduction.

In one refinement of the invention, either all of the advanced pressure chambers or all of the retarded pressure chambers are each connected to the volume accumulator by the additional channel.

In one alternative refinement of the invention, a number of advanced pressure chambers or a number of retarded pressure chambers are each connected to the volume accumulator by the additional channel, wherein the number is less than the total number of all advanced pressure chambers or retarded pressure chambers accordingly.

In another refinement of the invention, a cross section of the additional channels of two pressure chambers is different. This is especially advantageous for a reduction of the throttling.

In one special refinement of the invention, at least one part of the channels with the non-return valves has another non-return valve oriented toward the respective pressure chamber. The non-return valves can be arranged parallel to each other. This is especially advantageous for a reduction of the throttling, when this cannot be achieved by a larger cross section. Alternatively, the non-return valves could also be arranged in series relative to each other, in order to guarantee fault-free functioning of the volume accumulator, if one non-return valve is destroyed.

The invention also discloses an internal combustion engine that comprises a combustion chamber, a crankshaft driven by the combustion chamber, a camshaft controlling the combustion chamber, and a disclosed camshaft adjuster for transmitting rotational energy from the crankshaft to the camshaft.

BRIEF DESCRIPTION OF THE DRAWINGS

Embodiments of the invention are explained below with reference to a drawing in which.

DETAILED DESCRIPTION OF THE PREFERRED EMBODIMENTS

In the figures, identical elements are provided with identical reference symbols and are described only once.

Figure 1:
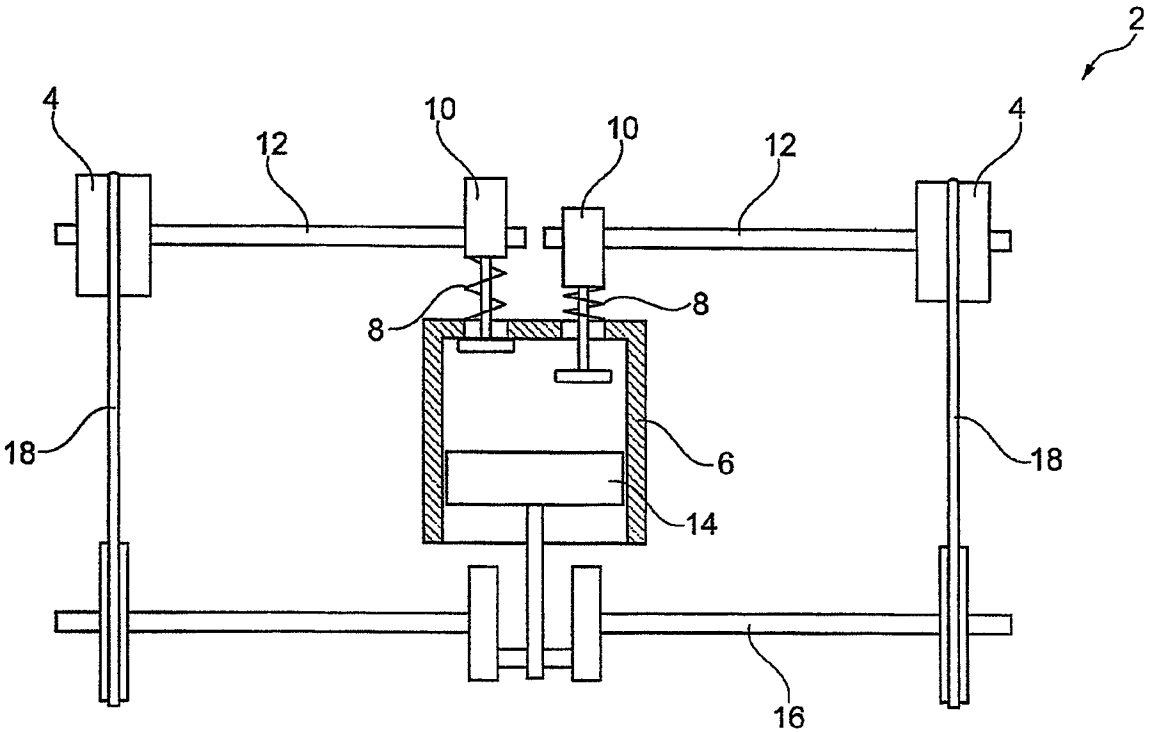
FIG. 1 shows a schematic diagram of an internal combustion engine with camshaft adjusters.

Reference will be made to FIG. 1 that shows a schematic diagram of an internal combustion engine 2 with camshaft adjusters 4.

In a known way, the internal combustion engine 2 comprises a combustion space 6 that can be opened and closed by valves 8. The valves are controlled by cams 10 on corresponding camshafts 12. A reciprocating piston 14 that drives a crankshaft 16 is further held in the combustion space 6. The rotational energy of the crankshaft 16 is transmitted at its axial end by a drive arrangement 18 to the camshaft adjuster 4. In the present example, the drive arrangement can be a chain or a belt.

The camshaft adjusters 4 are each placed in the axial direction on one of the camshafts 12, receive the rotational energy from the drive arrangement 18, and discharge this energy to the camshafts 12. Here, the camshaft adjusters 4 can delay or accelerate the rotation of the camshafts 12 relative to the crankshaft 14 with respect to time, in order to change the phase position of the camshafts 12 relative to the crankshaft 16.

Figure 2:
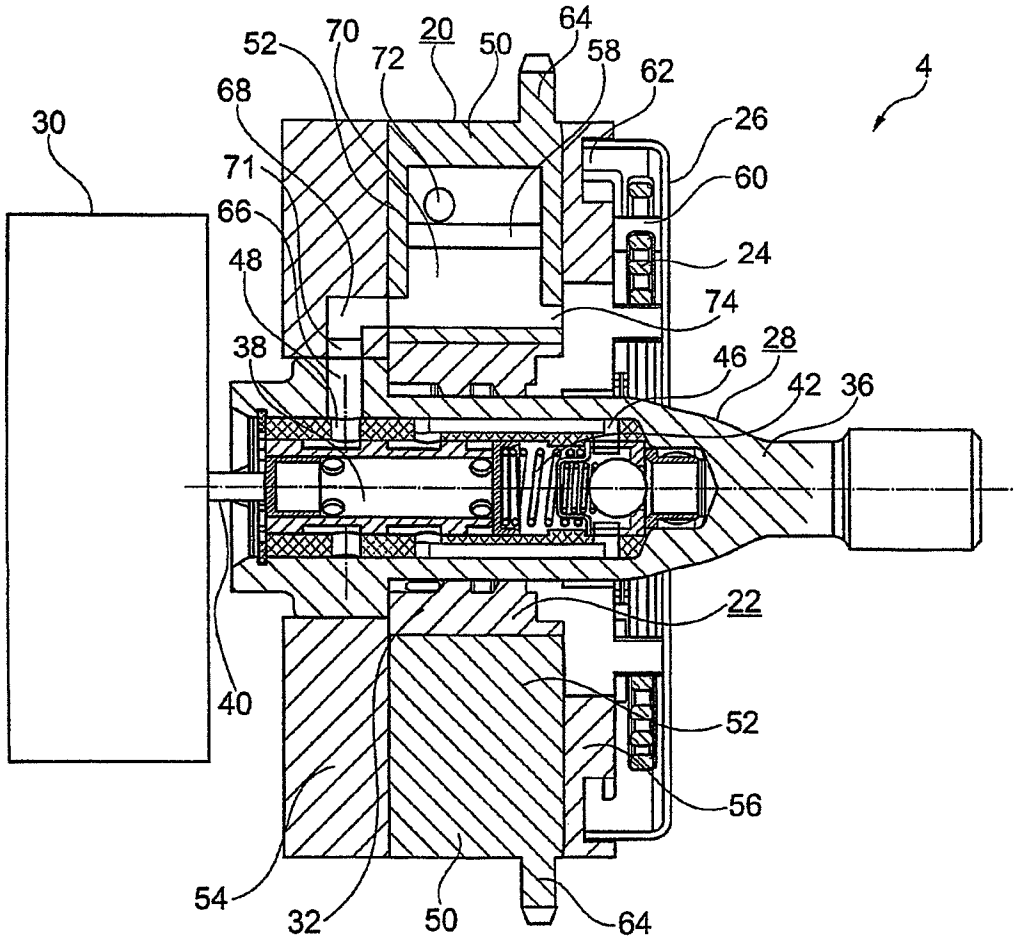
FIG. 2 shows a section view of a camshaft adjuster from FIG. 1 with a stator.

Reference is made to FIG. 2 that shows a section view of one of the camshaft adjusters 4 from FIG. 1 with a stator 20.

In addition to the stator 20, the camshaft adjuster 4 has a rotor 22 held in the stator 20, a spiral spring 24 biasing the stator 20 relative to the rotor 22, a spring cover 26 covering the spiral spring, a central valve 28 held centrally in the camshaft adjuster 4, and a central magnet 30 activating the central valve 28.

Figure 3:
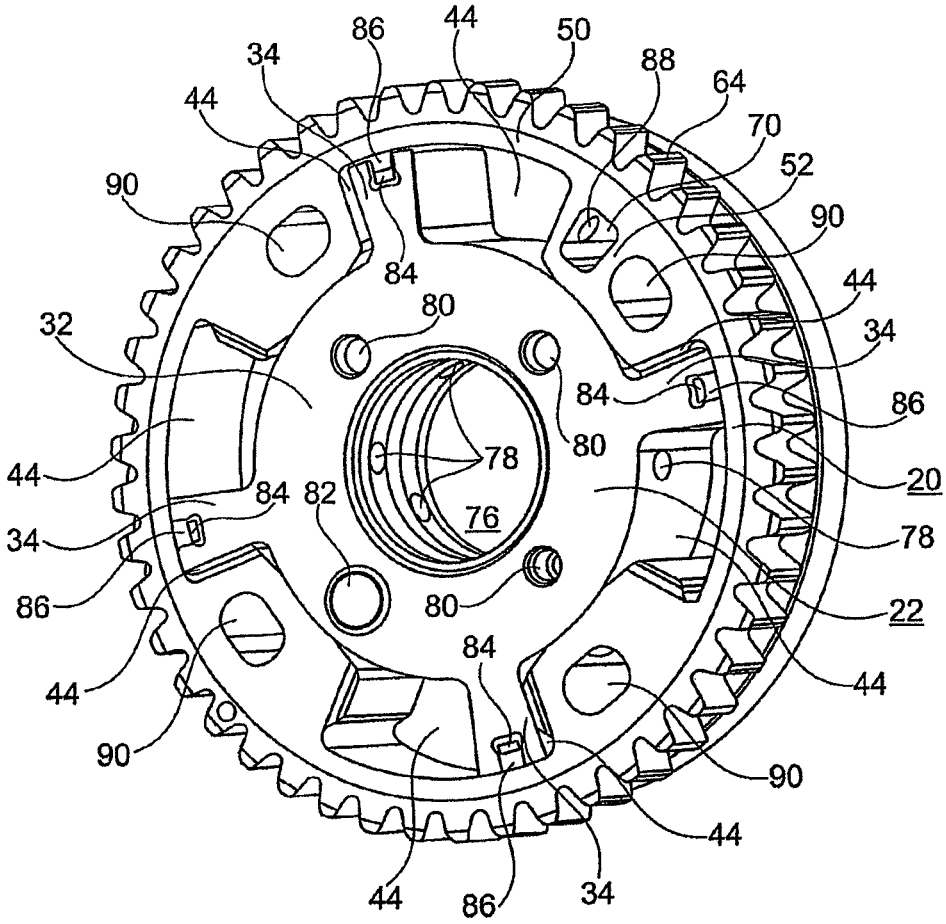
FIG. 3 shows a three-dimensional diagram of a stator from FIG. 2.
Figure 4:
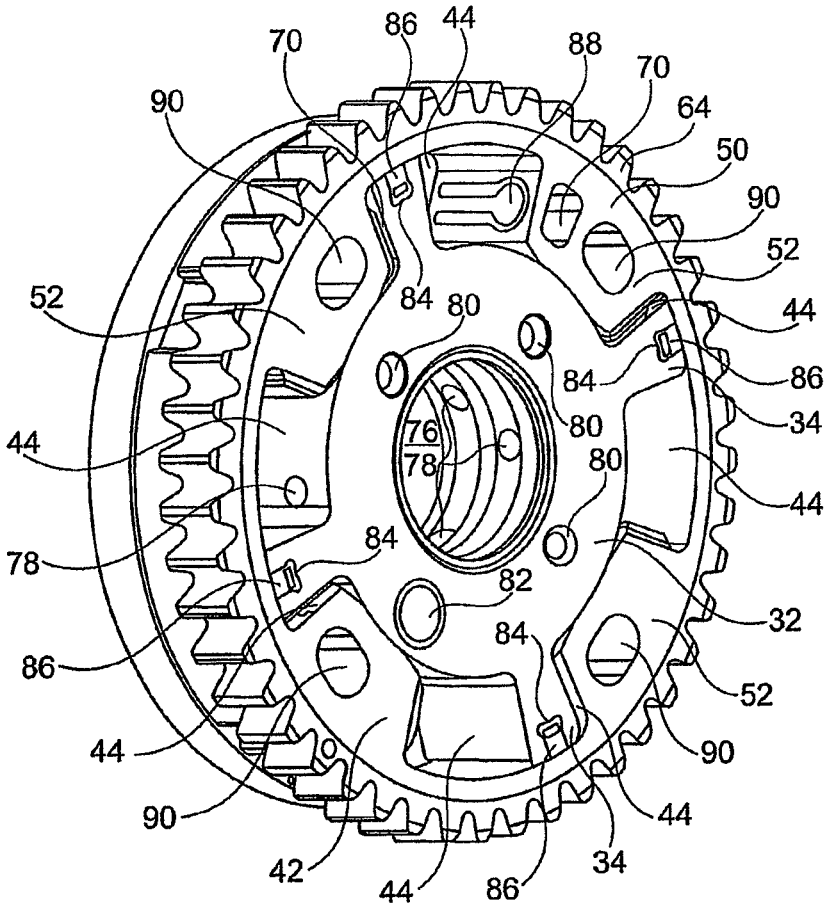
FIG. 4 shows a three-dimensional diagram of the stator from FIG. 3 in a different perspective.

The rotor 22 is held concentrically in the stator 20 and has, shown in FIGS. 3 to 5, vanes 34 that project from a hub 32 of the rotor. The rotor 22 is held concentrically on a central screw 36 of the central valve 28 that can be screwed into one of the camshafts 12 in which a control piston 38 is held so that it can move in the axial direction. This control piston is moved by a tappet 40 of the central magnet in the axial direction into the central screw 36 and can be pressed out from the central screw 36 in the axial direction by a spring 42. Depending on the position of the control piston 38 in the central screw 36, pressure chambers 44 of the camshaft adjuster 4 shown in FIGS. 3 and 4 are connected in a known way to a pressure connection 46 or to a volume accumulator connection 48 by which hydraulic fluid can be pumped into the pressure chambers 44 or emptied out from these chambers accordingly.

The stator 20 has a ring-shaped outer part 50 that can be seen well in FIGS. 3 and 4 that can project inward in the radial direction from the four segments 52. The ring-shaped outer part 50 is closed in the axial direction with a front cover 54 and a back cover 56, wherein the covers 54, 56 are held by screws 58 on the ring-shaped outer part 50. One of the screws 58 has an axial extension 60 that is used for suspending the spiral spring 24. A peripheral groove 62 is further formed in the back cover 56 on the axial side opposite the ring-shaped outer part 50. The spring cover 26 is clamped in this groove. On the radial periphery of the ring-shaped outer part 50 there are teeth 64 in which the driving means 18 can engage.

The central screw 36 has, as a volume accumulator connection 48, a radial hole 66 on which there is an axial channel 68 through the front cover 54. The channel 68 is placed in the radial direction on a groove 71 guided in the peripheral direction on the inner radial side of the front cover 54 directed toward the central screw 36, in order to allow a flow of hydraulic fluid in any position of the central screw 36 locked in rotation with the rotor 22 relative to the stator 20 between the radial hole 66 and the channel 68.

The channel 68 leads into a cavity 70 in one of the segments 52, wherein one of the screws 58 is also guided through this cavity 70. The cavity 70 is opened by a non-return valve 72 to the adjacent pressure space 44 of the camshaft adjuster 4, wherein the flow of hydraulic fluid is possible only from the cavity 70 to the pressure space 44, so that the pressure space 44 can draw hydraulic fluid stored in the cavity 70 in the case of an under-pressure. If the cavity 70 overflows with too much hydraulic fluid, the excess of hydraulic fluid is discharged, for example, to a not-shown oil pan by a tank connection 74. The cavity 70 in the segment 52 is therefore used as a volume accumulator for equalizing an under-pressure in the corresponding adjacent pressure chamber 44 of the camshaft adjuster 4.

Reference is made to FIGS. 3 and 4 that show a three-dimensional diagram of the stator 20 with a rotor 22 held therein from FIG. 2 from two different perspectives.

The rotor 22 has, in the center, an axial passage 76 in which the central valve 28 can be inserted. From the axial passage 76, radial holes 78 extend that can be connected to the work connections of the central valve 28, in order to fill or empty the pressure chambers 44 with hydraulic fluid. Additional axial passage holes 80 for holding not-shown pins are guided in the radial direction offset from the axial passage 76. On the rotor side, the spiral spring 24 can be hung on these pins. The rotor 22 further comprises an axial blind hole 82 offset in the radial direction from the axial passage 76. A not-shown locking pin can be held in this blind hole for locking the rotor 22 relative to the stator 20. The radial ends of the vanes of the rotor 22 have radial notches 84 in each of which a seal 86 is held for sealing the pressure chambers 44 relative to each other.

As can be seen from FIGS. 3 and 4, the vanes 34 engage in peripheral intermediate spaces bounded by the segments 52 on an inside of the ring-shaped outer part 50 and thus form the pressure chambers 44. Seen in the peripheral direction of the stator 20, an advanced pressure chamber 44 is formed in front of a vane 34, while a retarded pressure chamber 44 is formed behind a vane 34. In the present embodiment, only one of the advanced pressure chambers 44 is connected to a cavity 70 for equalizing the pressure by the non-return valve 72. However, all of the advanced pressure chambers 44 or all of the retarded pressure chambers 44 could also be connected with a corresponding cavity 70 formed in the segments 52 via non-return valves for equalizing the pressure.

In FIGS. 3 and 4, a hole 88 is guided in the peripheral direction of the stator 22 from the cavity 70 into the corresponding adjacent pressure chamber 44, wherein this hole connects the cavity 70 to the pressure chamber 44. On the side of the pressure chamber, the non-return valve 72 is arranged in the form of a small plate that presses onto the stator 20 for a flow of hydraulic fluid from the pressure chamber 44 into the cavity 70 and thus closes the hole 88. In the present construction, the pressure chambers 44 and the cavity 70 are connected to each other by means of a single hole 88. Both chambers 44, 70, however, can also be connected to each other by several holes 88 and by several non-return valves 72 accordingly. It is also possible to arrange several non-return valves 72 in series and/or in parallel in a single hole 88.

Continuous recesses 90 in the axial direction are further guided through the segments 52, wherein screws 58 can be guided through these recesses.

LIST OF REFERENCE NUMBERS

2 Internal combustion engine
4 Camshaft adjuster
6 Combustion space
8 Valve
10 Cam
12 Camshaft
14 Reciprocating piston
16 Crankshaft
18 Drive arrangement
20 Stator
22 Rotor
24 Spiral spring
26 Spring cover
28 Central valve
30 Central magnet
32 Hub
34 Vane
36 Central screw
38 Control piston
40 Tappet
42 Spring
44 Pressure chamber
46 Pressure connection
48 Volume accumulator connection
50 Ring-shaped outer part
52 Segment
54 Front cover
56 Back cover
58 Screw
60 Axial extension
62 Groove
64 Tooth
66 Radial hole
68 Channel
70 Cavity
71 Peripheral groove
72 Non-return valve
74 Tank connection
76 Axial passage
78 Radial hole
80 Axial passage hole
82 Axial blind hole
84 Radial notch
86 Seal
88 Passage hole in the peripheral direction
90 Axial recess

The invention claimed is:

1. A stator for a camshaft adjuster comprising a ring-shaped outer part for concentric holding of a rotor with vanes that project in an axial direction and are arranged on a periphery around the rotor, a segment that projects inward in a radial direction from the ring-shaped outer part for engaging between two of the vanes of the rotor, in order to form, together with the two vanes, pressure chambers of the camshaft adjuster, and a cavity formed in the segment of the stator and opens to one of the pressure chambers by a non-return valve.

2. The stator according to claim 1, wherein the cavity is openable outward in a peripheral direction of the ring-shaped outer part via the non-return valve.

3. The stator according to claim 1, wherein the non-return valve is arranged, viewed from the cavity, on an outer side of the segment.

4. The stator according to claim 1, further comprising a cover that is set on the ring-shaped outer part in the axial direction, and an additional cavity is formed in the cover.

5. A camshaft adjuster for adjusting a phase position of a camshaft relative to a crankshaft in an internal combustion engine, comprising a paired number of volume-changing advanced and retarded pressure chambers for adjusting a phase position via a rotor with vanes that project in an axial direction and are arranged on a periphery around the rotor mounted in a stator, the stator having a ring-shaped outer part, segments that project inward in a radial direction from the ring-shaped outer part that each engage between pairs of the vanes of the rotor, in order to form, together with the vanes, the advanced and retarded pressure chambers, and a volume accumulator formed as a cavity that extends through at least one of the segments that project inward in the radial direction from the ring-shaped outer part with an accumulator connection for storing hydraulic fluid from the pressure chambers and a tank connection for discharging the hydraulic fluid to a tank, wherein a number of the pressure chambers that is smaller than a total number of all pressure chambers are each connected by an additional channel having a non-return valve oriented toward each of the pressure chambers to the volume accumulator.

6. The camshaft adjuster according to claim 5, wherein all of the advanced pressure chambers or all of the retarded pressure chambers are each connected by the additional channel to the volume accumulator.

7. The camshaft adjuster according to claim 5, wherein at least one of a number of the advanced pressure chambers or a number of retarded pressure chambers are each connected by the additional channel to the volume accumulator, and the number is smaller than the total number of at least one of all of the advanced pressure chambers or the retarded pressure chambers accordingly.

8. The camshaft adjuster according to claim 5, wherein a cross section of the additional channels of two of the pressure chambers is different.

9. The camshaft adjuster according to claim 5, wherein at least one part of the channels with the non-return valves has another non-return valve oriented toward the respective pressure chamber.

10. An internal combustion engine comprising a combustion chamber, a crankshaft by the combustion chamber, a camshaft controlling the combustion chamber, and a camshaft adjuster according to claim 5 for transmitting rotational energy from the crankshaft to the camshaft.

* * * * *